United States Patent [19]

Hale et al.

[11] Patent Number: 4,942,916

[45] Date of Patent: Jul. 24, 1990

[54] CORE BLOWING MACHINE

[75] Inventors: Roger W. Hale, Hinckley; Gerald B. Senk, Jr., Cleveland, both of Ohio

[73] Assignee: Equipment Merchants International, Cleveland, Ohio

[21] Appl. No.: 220,082

[22] Filed: Jul. 18, 1988

[51] Int. Cl.[5] ..... B22C 9/12; B22C 13/12; B22C 15/22

[52] U.S. Cl. ..... 164/186; 164/201; 164/228

[58] Field of Search ..... 164/186, 180, 200, 201, 164/228

[56] References Cited

U.S. PATENT DOCUMENTS

| | | | |
|---|---|---|---|
| 3,096,547 | 7/1963 | Hunter et al. | 164/186 |
| 3,556,195 | 1/1971 | Lund | 164/201 X |
| 4,559,989 | 12/1985 | Kawai et al. | 164/201 X |
| 4,711,292 | 12/1987 | Rommel et al. | 164/201 X |
| 4,714,100 | 12/1987 | Bellis et al. | 164/180 X |
| 4,832,108 | 5/1989 | Nagarwalla et al. | 164/186 X |

FOREIGN PATENT DOCUMENTS

| | | | |
|---|---|---|---|
| 57-70056 | 4/1982 | Japan | 164/201 |
| 59-87954 | 5/1984 | Japan | 164/201 |
| 59-144554 | 8/1984 | Japan | 164/201 |
| 1050807 | 10/1983 | U.S.S.R. | 164/228 |

*Primary Examiner*—Nicholas P. Godici
*Assistant Examiner*—J. Reed Batten, Jr.
*Attorney, Agent, or Firm*—Renner, Otto, Boisselle & Sklar

[57] ABSTRACT

A foundry core blowing machine includes an upright frame with a blow head for a sand-resin mix fixed at the top. Sectionalized vertically movable rods extend through bushings at the top and bottom of the frame. Fixed to the rods are a cope support and a secondary table. The secondary table supports the cylinder of a cope-drag clamp piston-cylinder assembly with the rod of such assembly being connected to a primary table thereabove which slidably moves on the rods. The secondary table and the rods secured thereto are elevated independently of the cope-drag clamp so that the clamped cope and drag may be elevated to be clamped against the blow head, lowered for interposition of a cure head, and reclamped for cure, all while the cope and drag remain firmly clamped together. Only after curing are the cope and drag unclamped for lowering, stripping and removal of the core from the machine. The continuous high pressure clamp of the drag to the cope during blow and subsequent cure, even though the assembly is unclamped from the blow head prevents sand from entering between the abutting surfaces of the cope and drag and the forming of finning. The rods are formed in sections with the center section being readily replaced with rods of different height to control the shut height or window of the machine. The machine includes a removable blow plate and a shuttling curing head. Both the blow plate and cope may quickly be secured to and released from the machine, so that tooling sets, even including the curing head, may be assembled on a power operated tooling change conveyor and quickly assembled into and out of the machine upon vertical movement of the primary and secondary tables, each with a single cycle of the machine.

43 Claims, 8 Drawing Sheets

CORE BLOWING MACHINE

DISCLOSURE

This invention relates generally as indicated to a foundry core blowing machine and more particularly to a vertical horizontally parted cope and drag core blowing machine which achieves a high degree of precision or accuracy in the cores formed and which requires less subsequent handling, inspection or treatment, not only of the cores formed, but also the casting made.

BACKGROUND OF THE INVENTION

Foundry core blowing machines usually employ a single (one or a set of) clamp piston-cylinder assembly for assembling the cope and drag parts of the core box and for clamping the core box against the blow head and subsequently the cure or gassing head. Between the blow and cure, the box is actually unclamped.

Because of the blow operation the abutting core box parts (cope and drag) include a face seal. The seal exerts a force tending to separate the box parts. Also the blow operation creates what is known as "rebound" which again tends to open the cope and drag. When the sand resin mix is blown into the box it tends to be chilled by the blow operation. However, when it warms subsequently it tends to expand, again tending to open the box.

A box even slightly open at the parting line prior to cure creates on the core what is known as a fin. Initially only one or two grains of sand may get between the box parts at the parting line. However, the sand stays and as the machine cycle continues more and more sand enters between the box parts and the fin gets larger and larger with each subsequent core.

Finning results in loss of dimensional stability of the core and will eventually alter the dimension of the core to be out of spec. In fact, because of the problem core specifications are notoriously wide. Moreover, the sand abrades the edges of the tooling and creates excessive parting line wear. This in turn requires frequent repair or rebuilding of very expensive tooling. The problem also tends to create frequent cleaning and inspection during the operation of the machine which results in a slowing of the machine cycle or production rate.

Finning also causes subsequent inspection, modification or cleaning of the core itself, or even the casting made, all of which is extremely labor intensive. The problem is an anathema both to automation and accuracy. It would therefore be desirable to provide a high capacity automated and efficient machine which would minimize the finning problem. While it is desirable to reduce finning, it is also desirable to provide a fully automated machine which runs more continuously without tooling changes, but when such changes are required provides automatic quick change of tooling.

SUMMARY OF THE INVENTION

A foundry core blowing machine includes an upright frame with a blow head for a sand-resin mix fixed at the top. Sectionalized vertically movable rods extend through bushings at the top and bottom of the frame. Fixed to the rods are a cope support and a secondary table. The secondary table supports the cylinder of a cope-drag clamp piston-cylinder assembly with the rod of such assembly being connected to a primary table thereabove which slidably moves on the rods. The secondary table and the rods secured thereto are elevated independently of the cope-drag clamp so that the clamped cope and drag may be elevated to be clamped against the blow head, lowered for interposition of a cure head, and reclamped for cure, all while the cope and drag remain firmly clamped together. Only after curing are the cope and drag unclamped for lowering, stripping and removal of the core from the machine. The continuous high pressure clamp of the drag to the cope during blow and subsequent cure, even though the assembly is unclamped from the blow head prevents sand from entering between the abutting surfaces of the cope and drag and the forming of finning. The rods are formed in sections with the center section being readily replaced with rods of different height to control the shut height or window of the machine. The machine includes a removable blow plate and a shuttling curing head. Both the blow plate and cope may quickly be secured to and released from the machine, so that tooling sets, even including the curing head, may be assembled on a power operated tooling change conveyor and quickly assembled into and out of the machine upon vertical movement of the primary and secondary tables, each with a single cycle of the machine.

To the accomplishment of the foregoing and related ends the invention, then, comprises the features hereinafter fully described and particularly pointed out in the claims, the following description and the annexed drawings settng forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
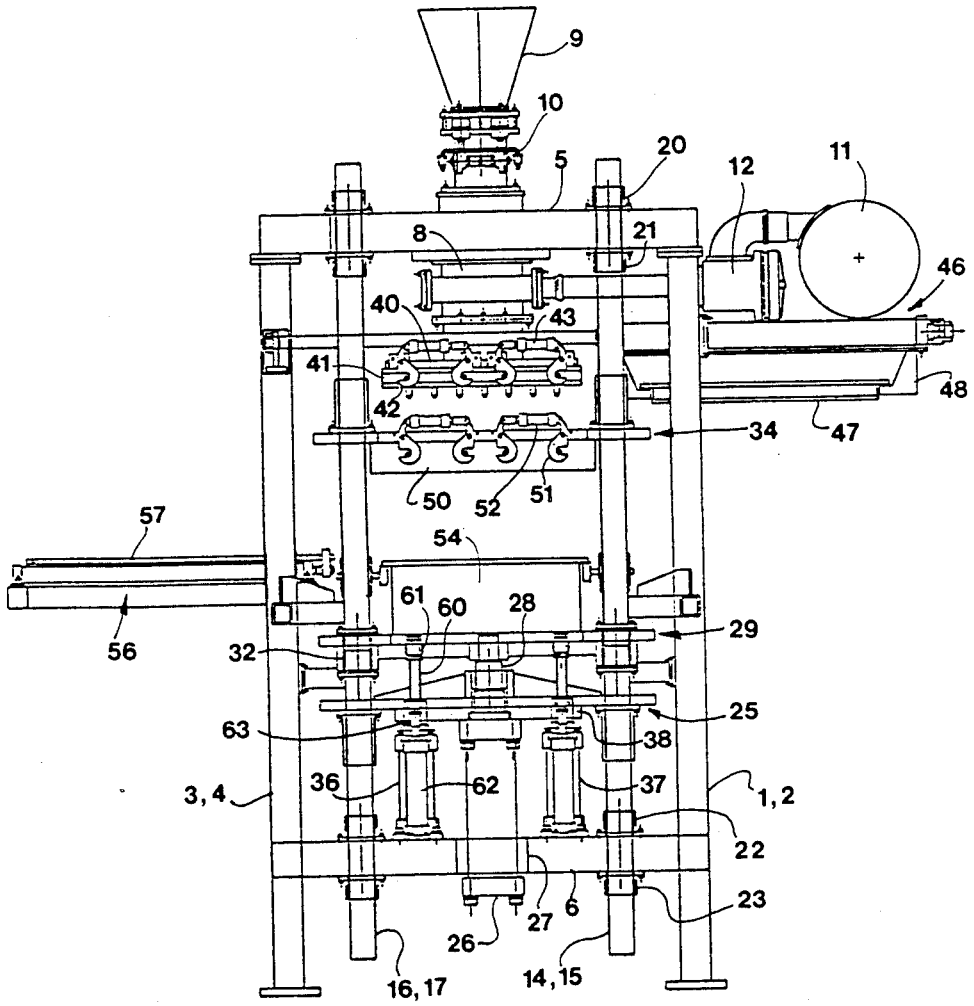
FIG. 1 is an elevation of a machine in accordance with the present invention.
Figure 2:
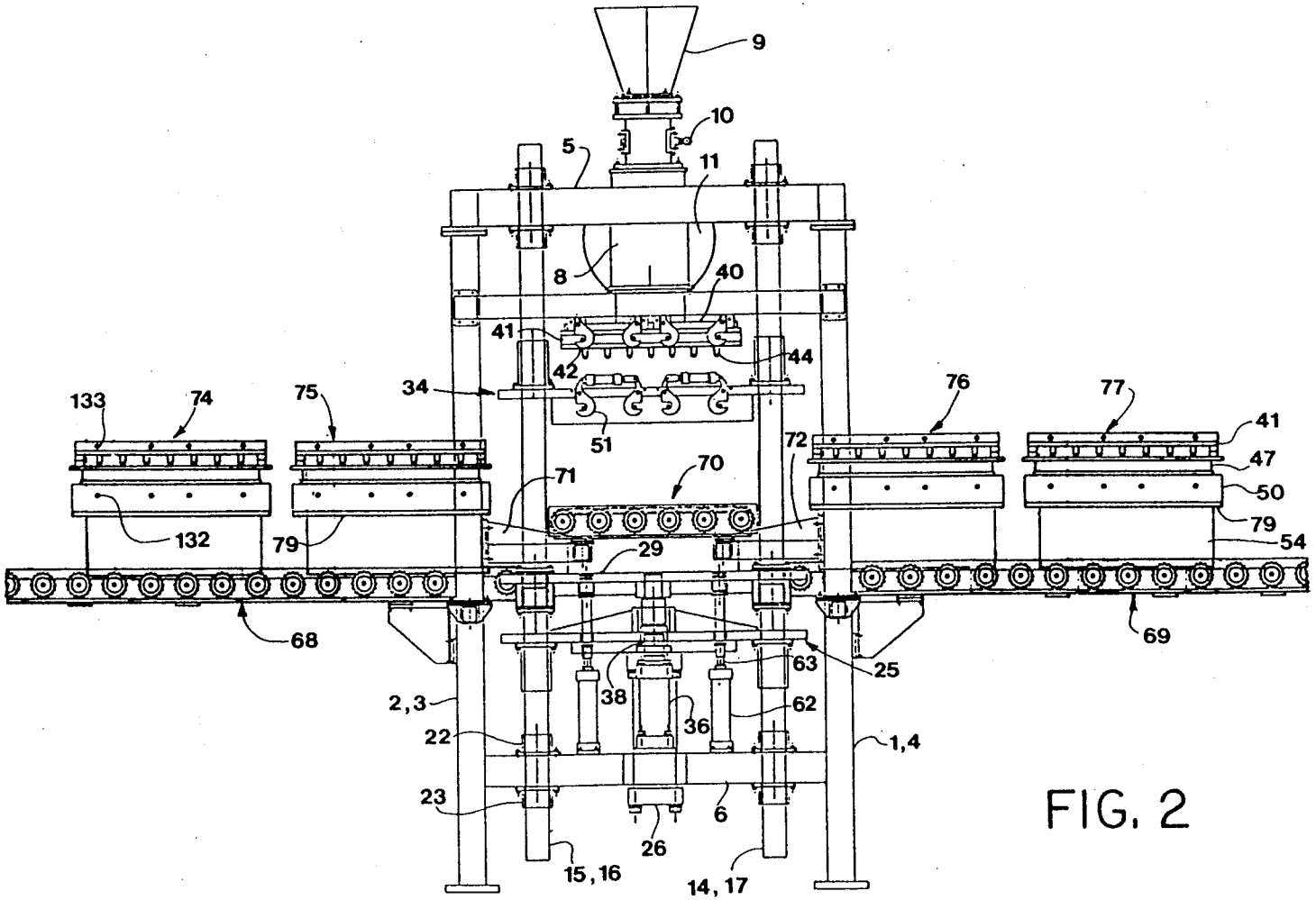
FIG. 2 is an elevation of the machine as seen from the side of FIG. 1 on a somewhat reduced scale and illustrating the tooling change conveyors.

Referring first to FIGS. 1 and 2 there is illustrated a vertical core blowing machine which includes an upright frame having four corner columns seen at 1, 2, 3, and 4. The columns are interconnected at the top by a top frame 5 and near the bottom by a horizontal frame 6.

The upper frame 5 supports a sand-resin mix reservoir 8 which is filled from chute 9 through valve 10. Also supported by the upper portion of the frame is a reservoir 11 and a blow valve 12.

Mounted for vertical movement in the top and bottom frames 5 and 6, respectively, are four rod assemblies 14, 15, 16 and 17. Each rod assembly is mounted in linear bushings as seen at 20 and 21 in the top frame and at 22 and 23 in the bottom frame. Thus each of the four rods may move up and down with respect to the fixed frames 5 and 6. Secured to the rod assemblies for movement therewith is a secondary table shown generally at 25. Secured to the underside of the center of the secondary table 25 is the cylinder of large hydraulic piston-cylinder assembly 26. The cylinder of such assembly projects downwardly through clearance hole 27 in the bottom frame 6 and the rod 28 of such assembly projects upwardly through the secondary table and is secured to the underside of primary table 29.

Unlike the secondary table, the primary table 29 is mounted for movement along the rod assemblies 14–17, being supported thereon by bushings indicated at 32 for each rod assembly.

Positioned above the primary table 29 is a cope mounting plate 34 which is fixed to the rod assemblies 14–17.

Positioned on top of the lower frame 6 are two hydraulic piston-cylinder assemblies 36 and 37. The blind end of each cylinder of such assemblies is fastened to the top of the bottom frame 6 on each side of the larger piston-cylinder assembly 26 and the rods of such piston-cylinder assemblies 36 and 37 indicated at 38 are connected to the underside of the secondary table 25. When the piston-cylinder assemblies 36 and 37 extend the secondary table moves upwardly and of course with it also moves the larger piston-cylinder assembly 26 and each of the rod assemblies 14–17. With the rod assemblies, the cope mounting plate 34 also moves since the cope mounting plate is, like the secondary table, fixed to the rod assemblies.

The lower end of the sand-resin mix reservoir 8 includes horizontal plate 40 to which is releasably clamped blow head 41 by means of the pivoting paired hook-shaped clamps 42 with each pair being pivoted in opposite directions by piston-cylinder assemblies 43. The blow head may include a series of downwardly projecting nozzles 44, the arrangement and length of which depend upon the particular core or set of cores being blown.

Extending laterally of the machine frame is a horizontally extending shuttle shown generally at 46 which supports a gassing head 47 on brackets 48. As will be appreciated, the gassing head is an open bottom frame or hood, again which may vary in dimension and depth. The gassing head is normally connected to a source of gas such as an amine gas which is a catalyst for the two-part resin in the conventional cold box process. In any event with the shuttle the gassing head 47 may be shuttled horizontally to the position beneath the blow head 41 when there is suitable clearance in the cycle of the machine.

The cope 50 or upper portion of the core box is clamped to the underside of the cope mounting plate 34 by similar paired hook shaped clamps 51 which are actuated by piston-cylinder assemblies 52.

The drag 54 or lower portion of the core box is supported directly on the primary table 29.

As seen in FIG. 1 extending on the opposite side of the frame as the gassing head shuttle 46 is a picker assembly 56 which shuttles picker fingers 57 horizontally into and out of the machine at an appropriate point in the cycle.

Also as seen in FIG. 1 there are four strip pins 60 mounted in bushings 61 on the primary table 29. Aligned with each strip pin is a strip piston-cylinder assembly as indicated at 62. Such strip piston-cylinder assemblies are mounted on the bottom horizontal frame 60 and the rods or strip pistons 63 thereof are shown retracted in FIGS. 1 and 2. The strip pins and strip rods of the strip piston-cylinder assemblies pass through clearance holes in the secondary table 25.

The tooling for the machine consists primarily of the cope and drag but if different cores are to be blown, the changing of the cope and drag may also required changing of the blow head 41 as well as the gassing head 47. Thus a complete tooling set would include the drag 54, the cope 50, the gassing head 47 and the blow head 41, although not each of the components may require changing for different cores.

As seen in FIG. 2 the machine may include horizontally extending powered conveyor sections 68 and 69 on each side of the machine as well as center conveyor section 70 at a somewhat higher elevation such section being supported on brackets 71 and 72 from the frame columns. As illustrated there are two tooling sets on each side of the machine frame as seen at 74, 75, 76 and 77 and each tooling set includes a drag 54, the cope 50, a gassing head 47 and blow head 41, stacked one on top of the other in that order. Each of the components of the tooling set may be provided with guide pins and bushings in conventional manner to maintain the tooling components in proper vertical alignment.

The drag 54 is provided with an upper flange indicated at 79 in FIG. 2 so that as a tooling set is transferred into the machine, the weight of the tooling set will be transferred from the bottom of the drag on the conveyors 68 or 69 to the flange 79 on the conveyor 70, the top of the latter being substantially horizontally aligned with such flange.

The conveyors 68 and 69 may be of substantial length, and, for example, up to five tooling sets may be provided on each conveyor. This enables the quick change of tooling as hereinafter described and also enables a tooling set readily to be removed from the machine and replaced by another, even if identical, so that a tooling set may be properly serviced or cleaned outside of the machine as production continues.

Figure 3:
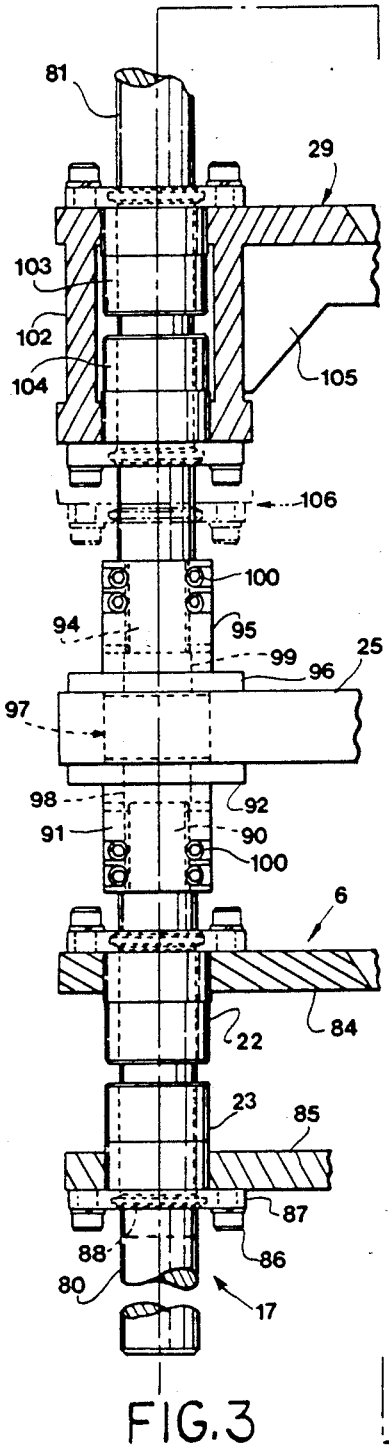
FIG. 3 is an enlarged broken elevation of the lower portion of a rod assembly.
Figure 4:
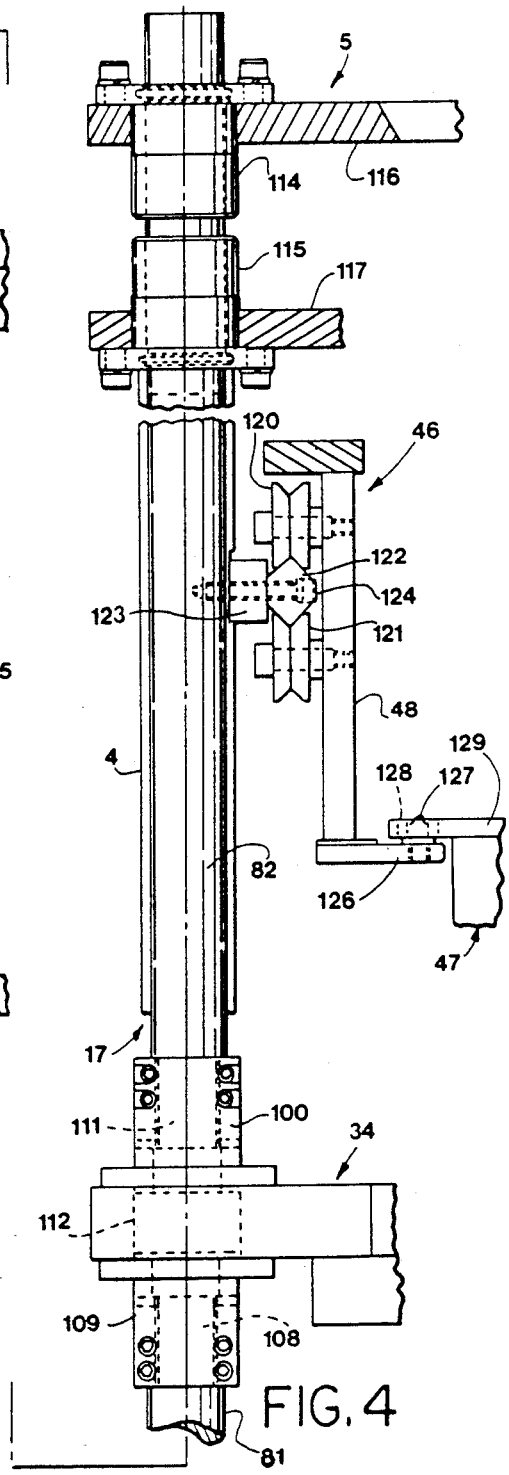
FIG. 4 is a broken continuation of FIG. 3 showing the upper portion of the rod assembly.

Referring now to FIGS. 3 and 4 there is illustrated in more detail a vertical rod assembly and the various components either fixed to the rod assembly or slidable with respect thereto. The rod assembly 17 illustrated in FIGS. 3 and 4 actually comprises three separate rod sections, namely: lower rod section 80; middle rod section 81; and upper rod section 82. The lower rod section 80 as seen in FIG. 3 extends through parallel plates 84 and 85 which are included in the bottom frame 6. As indicated, the rod section 80 passes through bushings 22 and 23 which may be in either the inverted position seen in FIG. 3 or in the projecting position seen in FIGS. 1 and 2. The bushings are held to the parallel plates by fasteners 86 extending through the bushing flanges 87. Also, as indicated, each bushing includes a readily replaceable rod wiper.

The upper end of the lower rod section 80 is threaded as indicated at 90 and such threads engage the internal threads on split sleeve 91 which is provided with a flange 92 secured to secondary table 25.

The lower end of intermediate rod section 81 is provided with a threaded end 94 in similar fashion engaging internal threads on split sleeve 95, the flange 96 of which is secured to the top of secondary table 25. Proper alignment of the two sections is obtained by a shouldered dowel or pilot pin 97 which has reduced diameter end projections 98 and 99 fitting in the flanged ends of the split sleeves 91 and 95, respectively. As illustrated, the fasteners 100 may be employed to draw the split end of the sleeves tightly toward each other.

As illustrated at the top of FIG. 3 the primary table 29 may be provided with corner hubs 102 through which the rod section 81 extends with bushings 103 and 104 being fastened to the ends of the hub in the same manner as the bushings 22 and 23 are fastened to the respective plates 84 and 85 seen at the bottom of FIG. 3. As illustrated, the primary table may be reinforced as seen at 105 and the axial length of the hub 102 may vary as indicated by the phantom line position 106.

Turning now to FIG. 4 the upper end of the middle or intermediate rod section 81 is threaded as indicated at 108 and secured to internally threaded split sleeve 109 in turn secured to cope mounting plate 34. Secured to the top of the cope mounting plate is a split sleeve 110 which engages the threaded lower end 111 of the top rod section 82. Again a shouldered dowel 112 is employed for alignment purposes. The upper rod section extends through bushings 114 and 115 secured to parallel plates 116 and 117, respectively, which may form the top frame 5.

It can thus be seen that the rod assembly slides up and down with respect to the bottom frame 6, is secured or fixed to the secondary table 25, slides with respect to the primary table 29, is fixed to the cope mounting plate 34 and slides with respect to the top frame 5. The intermediate or center section 81 of the rod assembly extends from the secondary table 25 to the cope mounting plate 34 and the length of this rod section controls the shut-height or window of the machine. This window may be altered by replacing the rod section 81 with rod sections of different length.

FIG. 4 also illustrates the gassing head or frame shuttle 46 which is in the form of a carriage which includes upper and lower V-rollers 120 and 121 riding on diamond shaped rails 122 which are secured through spacer 123 by fasteners 124 to the interior of fixed frame column 4.

As illustrated, the bracket 48 includes an inwardly directed bottom arm 126 which includes an upwardly directed pilot pin 127 fitting within bushing 128 in the top flange 129 of the gassing heat 47. There are of course four such brackets, pins and bushings supporting the gassing head for such shuttling movement. The gassing head can of course be lifted off of the pins and when so lifted will clear the top of the pins.

Both the picker assembly and the gassing head shuttle may be operated horizontally by long stroke piston-cylinder assembly and will normally be operated at the proper sequence in the cycle of the machine. However, as in connection with other components, such shuttles may be jogged as in connection with the insertion or removal of the tooling.

Referring now to FIG. 2 it will be seen that the cope 50 as well as the blow head 41 are provided with laterally projecting pins as seen at 132 and 133, respectively. These pins and the hook-shape clamps 42 and 51 may be provided on two parallel sides of the tooling or on all four sides, as illustrated.

In order to place a set of tooling into the machine, the primary and secondary table will be in the down position as seen in FIG. 2 and the hooks 42 and 51 of each pair will be opened or pivoted toward each other by extension of the piston-cylinder assemblies 43 and 52, respectively. Also, the gassing head shuttle will be retracted or in the position seen in FIG. 1.

With the machine thus ready to receive a tooling set, the conveyor 68 may be energized to index the tooling set 75 to the right as seen in FIG. 2 with the tooling set within the machine being supported by the conveyor section 70 engaging the drag flange 79. With the tooling set in the proper position, both tables 25 and 29 are elevated by extension of the piston-cyliner assembly 26 as well as the piston-cylinder assemblies 36 and 37. The complete elevation of the tooling set places the blow head 41 against the plate 40 and the cope 50 against the cope mounting plate 34, all in elevated position. At this point the piston-cylinder assemblies 43 and 52 are extended to cause the hooks to engage the lateral pins on the blow head and cope, respectively. It is noted that the pins are slightly inwardly offset from the hook pivots and with the configuration of the hook the blow head and cope are tightly secured to the plate 40 and cope mounting plate.

At this time the gassing head shuttle is moved horizontally into the machine so that the pins 127 line up with the bushings 128. The tables are now returned to the original down position. Since the blow head is secured to the plate 40 it will remain where it is. The lowering of the gassing head on top of the cope will cause it to engage the gassing head shuttle. The cope and drag continue down to the position seen in FIG. 1 and the gassing head shuttle is retracted to position the gassing head also as seen in FIG. 1. At this point the machine is ready to commence operation.

To remove a tooling set from the machine the above described operation is simply reversed. The gassing head is simply shuttled in and the tooling parts are clamped together by elevation of the tables. After the gassing head shuttle is withdrawn and the hook-shape clamps opened, the lowering of the table simply places the assembled tooling set on the conveyor section 70 for removal either left or right as seen in FIG. 2 from the machine. In this manner the tooling sets may very quickly be removed, replaced, or changed, either to permit production of different cores, or to permit alternately usable tooling to be cleaned and serviced outside of the machine.

Operation

From the initial start up position seen in FIG. 1 the first step in the cycle is to extend the center clamp piston-cylinder assembly 26. This in turn elevates the primary table 29 to clamp the drag 54 against the cope under high pressure. The primary table 29 simply slides along the rod assemblies 14–17 and since the secondary table, to which the piston-cylinder assembly 26 is secured and the cope mounting plate 34 are fixed to the rod, clamping pressure of the drag to the cope to form the core box is achieved without yet any vertical movement of the rod assemblies 14–17.

Figure 6:
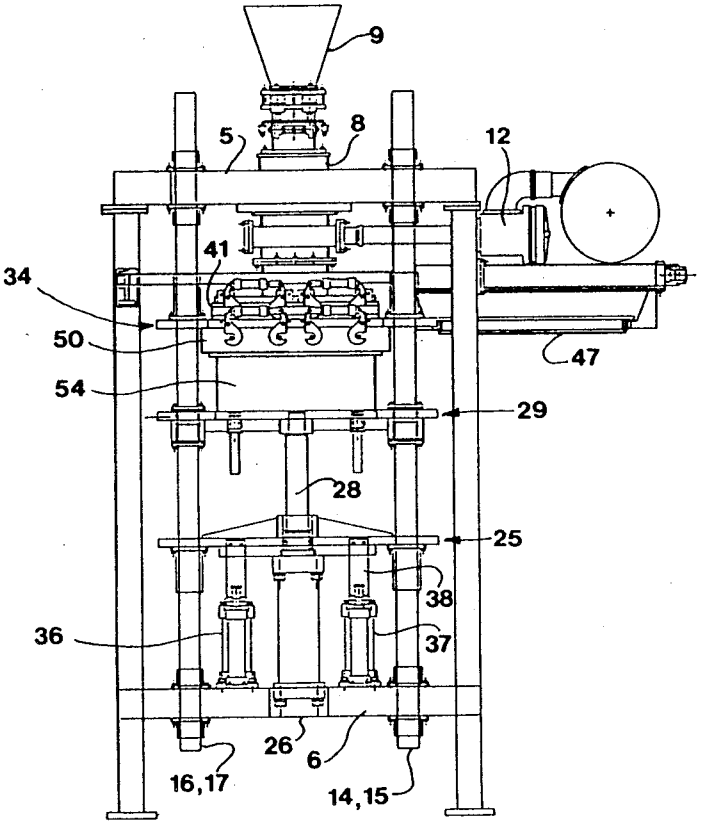
FIGS. 5–14 are elevations of the machine on a reduced scale illustrating the positions of the components of the machine during a typical cycle of operation.

As seen in FIG. 6, after the core box is formed and firmly clamped, the piston-cylinder assemblies 36 and 37 are then extended to raise the drag/cope (core box) to be clamped against the blow head 41. Since the rods 38 of the piston-cylinder assemblies 36 and 37 are connected to the secondary table which is in turn fixed to the rod assemblies 14–17, the entire assembly elevates including the clamped cope and drag which is in turn then clamped against the blow head. The high pressure clamp of the drag to the cope is maintained. In the position of FIG. 6 the blow valve is opened and the sand-resin mix is blown into the core box.

Figure 5:
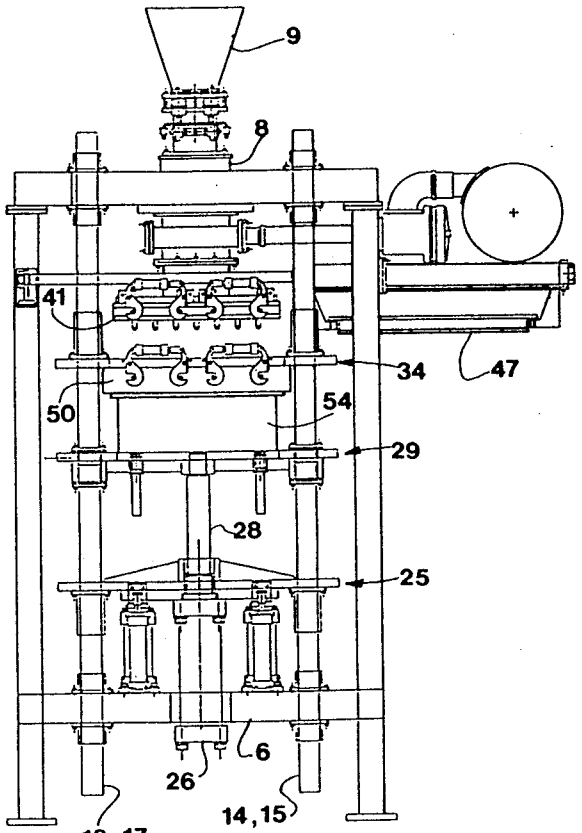
Figure 7:
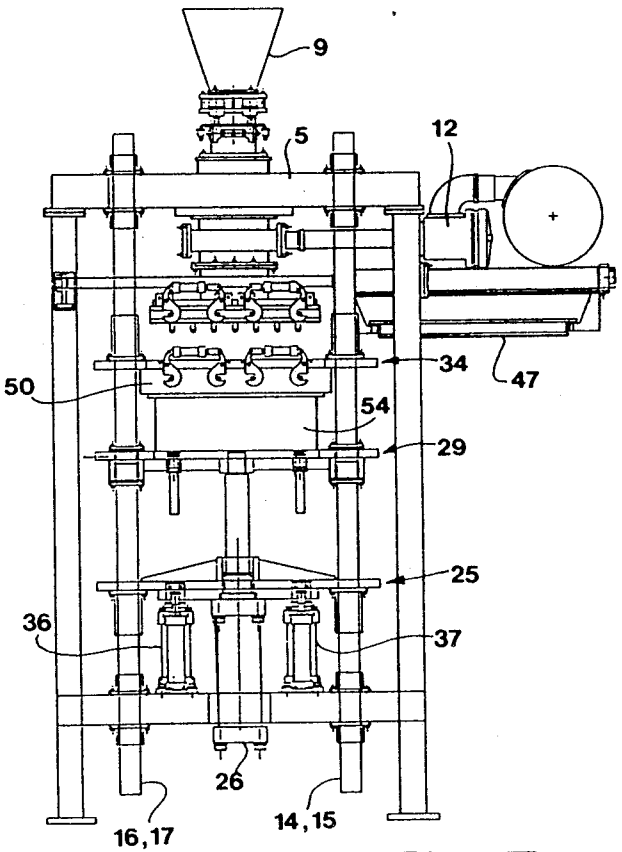

Referring now to FIG. 7 following the blow operation piston-cylinder assemblies 36 and 37 are retracted to drop the drag/cope (core box) to clear the gassing head 47 for horizontal shuttling into the machine. In such position the parts are in the same position as in FIG. 5 only the sand-resin mix has been blown into the core box. Again, the high pressure clamp of the drag to the cope is maintained.

Figure 8:
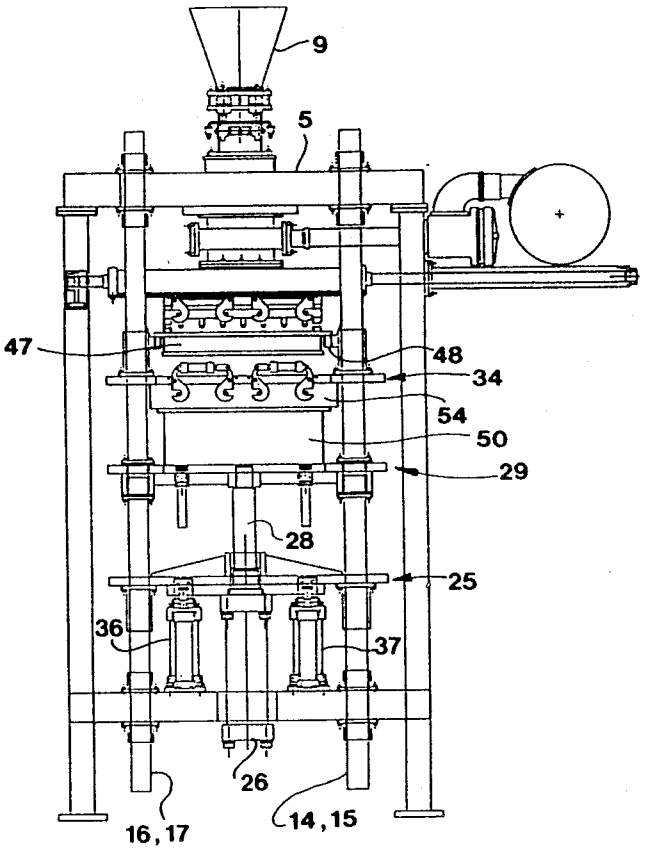

In FIG. 8 the gassing head 47 has now horizontally been shuttled into the machine and is positioned on the brackets 48 in alignment with the core box below and the blow head above. Again the high pressure clamp of the drag to the cope is maintained.

Figure 9:
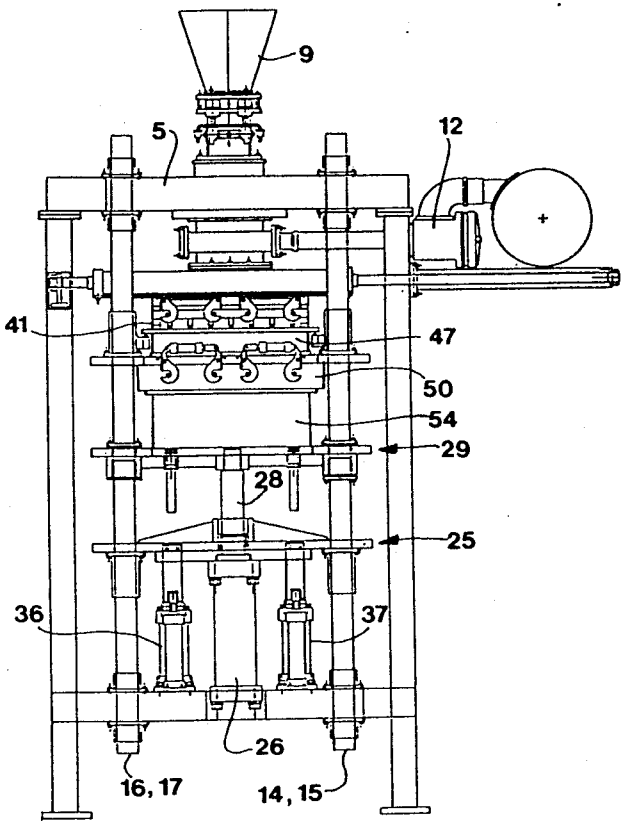

As indicated in FIG. 9 the piston-cylinder assemblies 36 and 37 are again extended elevating the drag/cope (core box) to pick up the gassing head and clamp the entire assembly against the blow head 41. Again the high pressure clamp of the drag to the cope is maintained by extension of the piston-cylinder assembly 26. The core or cores as the case may be are now ready for gassing.

Figure 10:
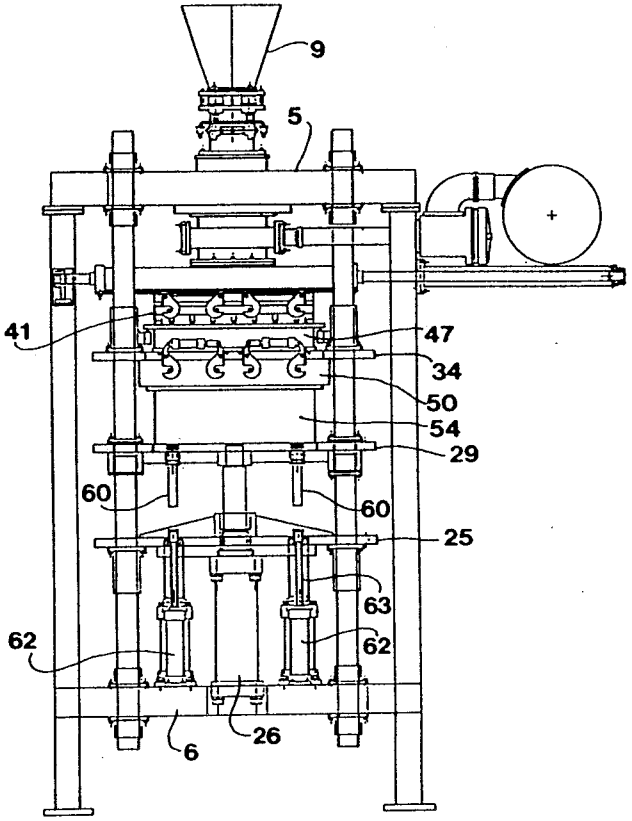

As seen in FIG. 10, while gassing takes place the rods 63 of strip piston-cylinder assemblies 62 extend. In the illustrated embodiment there are four such strip piston-cylinder assemblies 62 and as the gassing operation proceeds the strip pistons extend without the aid of flow dividers. Again the high pressure clamp of the drag to the cope is maintained by extension of the piston-cylinder assembly 26.

The gassing operation cures the sand-resin mix so that the cores harden sufficiently to be stripped from the cope and drag and to be removed from the machine.

Figure 11:
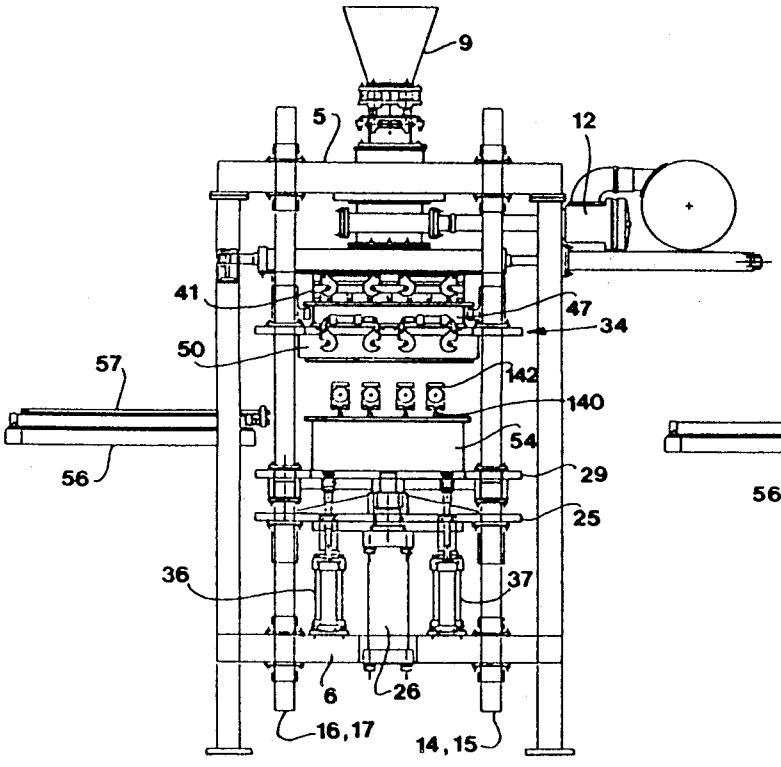

As indicated in FIG. 11 the piston-cylinder assembly 26 is initially retracted unclamping the drag from the cope stripping the cores from the cope. As the drag continues to move downwardly, the strip pins 60 engage the tops of the strip piston rods 63 holding the strip pins in position as the drag descends. The strip pins, in conventional manner, are connected to a plate in the bottom of the drag which in turn support a multiplicity of strip pins 140 supporting the cores 142 against vertical movement. Thus as the drag 54 continues down the cores 142 are held above the drag on the pins 140.

Figure 12:
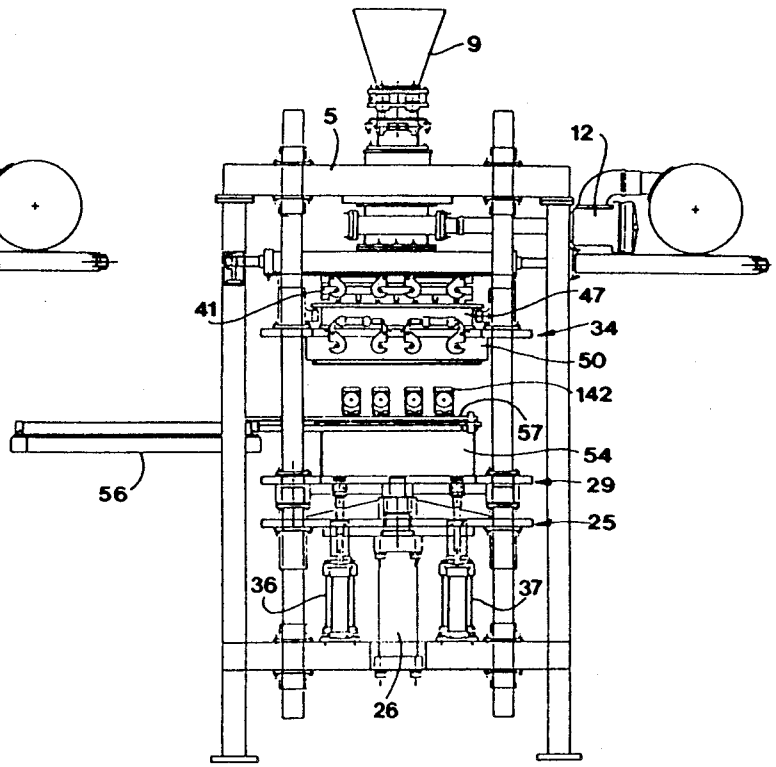

As seen in FIG. 12, with the cores held in their elevated position above the drag the picker assembly 56 is extended to shuttle the picker fingers 57 in to a position just beneath the cores 142.

Figure 13:
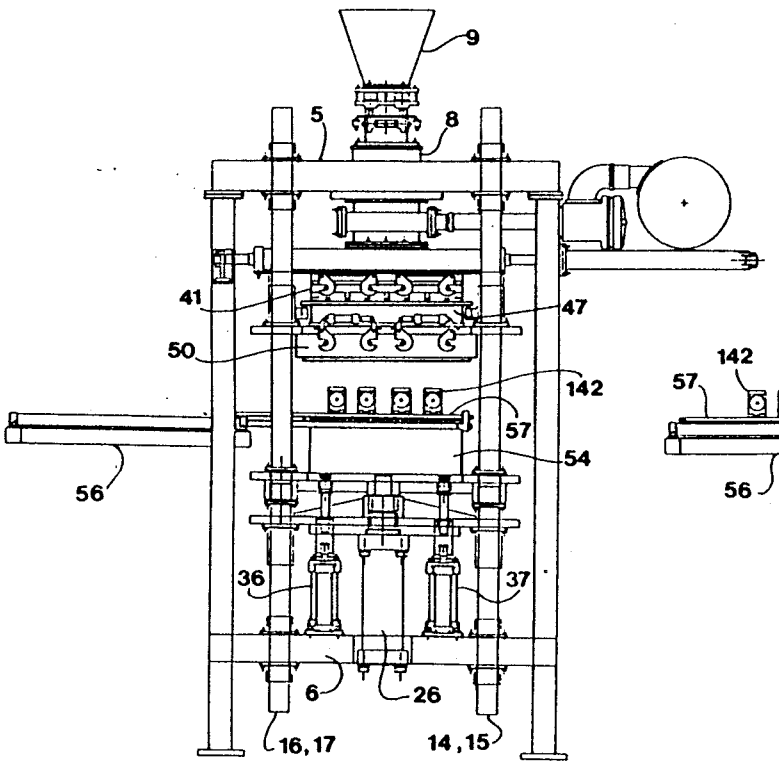

As seen in FIG. 13 the strip piston-cylinder assemblies 62 are now fully retracted which retracts the strip pins 60 and of course the pins 140 to set the cores 142 the short distance on the picker fingers 57.

Figure 14:
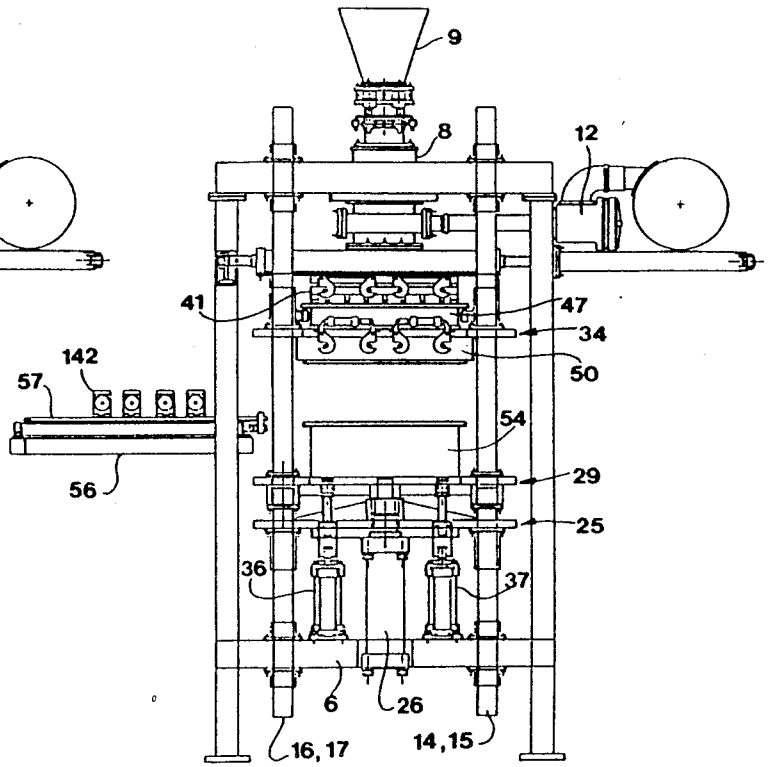

In FIG. 14 the cores are now out of the machine on the picker assembly and both the primary and secondary tables return to their start position as the gassing head shuttles out of the machine. At this point the cycle is completed.

It will be appreciated that the present invention is equally usable in a hot box process rather than in the cold box process illustrated. In the hot box process a heater will be employed instead of the gassing head but in any event the drag will remain firmly clamped to the cope during both the blowing operation and the subsequent curing operation, whether that curing operation be by heat or gas.

It can now be seen that there is provided in a cope and drag vertical core blowing machine a first clamp means 26 to clamp the drag to the cope to form the core box, and a second clamp means 36 and 37 to clamp the core box to a blow head and subsequently to a cure head, to solidify the core or cores for removal, all while the first clamp means maintains the cope and drag clamped together under high pressure.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A vertical cope and drag foundry core blowing machine comprising an upright frame, a fixed blow head at the top of said frame, a set of guides mounted for vertical sliding movement in said frame, a cope mounting plate fixed to said guides beneath said blow head, a primary table adapted to support a drag mounted on said guides beneath said cope mounting plate for vertical sliding movement therealong, a secondary table beneath said primary table fixed to said guides, first clamp means to elevate said primary table to clamp a drag thereon against a cope to form a core box, and second clamp means to elevate said secondary table and thus said guides to clamp the core box against the blow head.

2. A foundry core blowing machine as set forth in claim 1 wherein said guides each comprise guide rod assemblies, each assembly including three aligned guide rods forming an upper, lower, and intermediate rod section, said intermediate rod section extending between said secondary table and said cope mounting plate.

3. A foundry core blowing machine as set forth in claim 2 wherein each said intermediate rod section is removably secured to said secondary table and said cope mounting plate, the length of said intermediate section controlling the cope/drag shut height of the machine.

4. A foundry core blowing machine as set forth in claim 3 wherein each said upper and lower guide rods are removably secured to said cope mounting plate and said secondary table, respectively.

5. A foundry core blowing machine as set forth in claim 4 including alignment dowel means in said cope mounting plate and said secondary table to maintain said guide rod sections in alignment.

6. A foundry core blowing machine as set forth in claim 1 wherein said first clamp means comprises a piston-cylinder assembly, the piston of which is connected to said primary table and the cylinder of which is connected to said secondary table, and said second clamp means comprises a piston-cylinder assembly extending between said frame and secondary table.

7. A foundry core blowing machine as set forth in claim 6 wherein said frame includes a bottom horizontal frame supporting said second clamp means.

8. A foundry core blowing machine as set forth in claim 7 wherein said first clamp means comprises a single piston-cylinder assembly, the cylinder of which is mounted on the underside of said secondary table.

9. A foundry core blowing machine as set forth in claim 8 wherein said second clamp means comprises a pair of piston-cylinder assemblies one on each side of said first clamp means supported on said bottom horizontal frame.

10. A foundry core blowing machine for blowing cores as set forth in claim 9 wherein said primary table includes downwardly extending vertically movable strip pins, and aligned strip piston-cylinder assemblies mounted on said bottom horizontal frame, the pistons of which when extended project through said secondary table to engage said strip pins to facilitate stripping of the drag from the cores.

11. A foundry core blowing machine as set forth in claim 10 including horizontally movable picker fingers, said strip pins when extended holding the cores at an elevation just above said picker fingers, and when retracted setting the cores on said picker fingers.

12. A foundry core blowing machine as set forth in claim 1 including a cure head shuttle at the top of the machine operative to shuttle a cure head between the core box and blow head after said second clamp means has lowered the core box following the blowing of a sand-resin mix into the core box, whereby said second clamp means can again elevate the core box to clamp the cure head against the blow head all while said first clamp means maintains the drag clamped against the cope.

13. A foundry core blowing machine as set forth in claim 12 wherein the clamping of the cure head against the blow head lifts the cure head from the cure head shuttle.

14. A foundry core blowing machine as set forth in claim 1 wherein said guides comprise guide rods mounted for vertical movement in guide bushings in said frame.

15. A foundry core blowing machine as set forth in claim 1 wherein said second clamp means comprises a piston-cylinder assembly extending between said frame and secondary table.

16. A foundry core blowing machine as set forth in claim 1 wherein said first clamp means comprises a piston-cylinder assembly, the piston of which is connected to said primary table and the cylinder of which is connected to said secondary table.

17. In a vertical cope and drag core blowing machine, means to elevate the drag to clamp the drag against the cope under high pressure to form a core box, means to elevate the core box against a blow head to blow a sand-resin mix into the box, lower the box, and then re-elevate the box against a cure head interposed between the box and blow head to cure the sand-resin mix, all while said drag is clamped against the cope under high pressure.

18. A core blowing machine as set forth in claim 17 including first clamp means to clamp the drag against the cope, and second clamp means to clamp the core box against the blow head and cure head.

19. A core blowing machine as set forth in claim 18 including a cope mounting plate and a drag supporting primary table, said first clamp means being operative to move said primary table toward said cope mounting plate.

20. A core blowing machine as set forth in claim 19 including a secondary table fixed with respect to said cope mounting plate, said first clamp means extending between said secondary table and said primary table to move the latter with respect to said secondary table and thus said cope mounting plate.

21. A core blowing machine as set forth in claim 20 wherein said second clamp means elevates said secondary table including said first clamp means to clamp the box against the blow head and cure head.

22. A core blowing machine as set forth in claim 21 including vertically extending guide rods, said cope mounting plate and said secondary table being fixed to said guide rods while said primary table is movable therealong.

23. A core blowing machine as set forth in claim 22 including a vertical frame supporting said blow head at the top thereof and including a bottom portion, said guide rods being mounted in said frame for vertical movement.

24. A core blowing machine as set forth in claim 23 wherein said frame includes a lower horizontal portion, said second clamp means extending between said lower horizontal portion and said secondary table.

25. A core blowing machine as set forth in claim 24 including retractable strip means mounted on said lower horizontal portion and adapted to be extended through said secondary table to facilitate the drawing of the drag from the blown and cured cores.

26. A foundry core blowing machine comprising a vertical frame, a blow head fixed at the top of said frame, a separable cope and drag supported in said frame for assembly and clamping one to the other and against said blow head under high pressure, means to blow a sand-resin mix into said assembled and clamped cope and drag, means to lower said cope and drag after the sand-resin mix is blown therein to position a cure head between the cope and blow head and reclamp the cope and drag against the cure head while maintaining such high clamp pressure between the cope and drag, and means to lower said cope and drag after curing the sand-resin mix for stripping such core while releasing the clamp pressure between the cope and drag.

27. A foundry core blowing machine comprising an upright frame, a sand-resin mix blow head fixed at the top of the frame, a core box including a cope and a drag, means to elevate the drag against the cope to assemble the cope and drag and clamp the drag against the cope under high pressure to form the core box, and means to elevate the assembled cope and drag against the blow head for blowing of the sand-resin mix within the core box, lower the core box after such sand-resin mix is blown therein, and then again elevating the assembled cope and drag against a cure head positioned between such core box and the blow head for curing of the sand-resin mix, all while the drag is clamped against the cope under high pressure.

28. A foundry core blowing machine as set forth in claim 27 including first clamp means to clamp the drag against the cope, and second clamp means to clamp the core box first against the blow head and then against the cure head.

29. A foundry core blowing machine as set forth in claim 28 including a cope mounting plate and a drag supporting primary table, said first clamp means being operative to move said primary table toward said cope mounting plate.

30. A foundry core blowing machine as set forth in claim 29 including a secondary table fixed with respect to said cope mounting plate, said first clamp means extending between said secondary table and said primary table to move the latter with respect to said secondary table and thus said cope mounting plate.

31. A foundry core blowing machine as set forth in claim 30 wherein said second clamp means elevates said secondary table including said first clamp means to clamp the core box against the blow head and cure head.

32. A foundry core blowing machine as set forth in claim 31 including vertically extending guide rods, said cope mounting plate and said secondary table being fixed to said guide rods while said primary table is movable therealong.

33. A foundry core blowing machine as set forth in claim 32 wherein said guide rods are mounted in said upright frame for vertical movement.

34. A foundry core blowing machine as set forth in claim 33 wherein said frame includes a lower horizontal portion, said second clamp means extending between said lower horizontal portion and said secondary table.

35. A foundry core blowing machine as set forth in claim 34 including retractable strip means mounted on said lower horizontal portion and adapted to be extended through said secondary table to facilitate the drawing of the drag from the blown and cured cores.

36. A foundry core blowing machine comprising a vertical frame, a sand-resin mix blow head fixed to the top of said frame, cope support means below said head, said cope support means comprising means to secure thereto and release therefrom a cope, a table beneath said support means for a drag, clamp means at the bottom of said frame to elevate said table to clamp the cope against the drag and further to elevate the clamped cope and drag against the blow head, and a tooling change conveyor extending horizontally of the machine and adapted to support the drag in the lowermost position of said clamp means, and sets of tooling including vertically assembled copes and drags mounted on said tooling change conveyor whereby such tooling may be changed by releasing said means to secure the cope when the drag is clamped against the cope, lowering said clamp means to lower the release cope on the drag to place the tooling on the conveyor, shifting the tooling from the machine while replacing such tooling with another set, and then elevating such another set to secure the cope to said support means.

37. A foundry core blowing machine as set forth in claim 36 wherein said blow head includes support means to secure thereto and release therefrom a blow plate, and said clamp means including a second clamp means to elevate said table to elevate the cope against the blow plate whereby the blow plate may be supported on the cope to form a part of the set of tooling.

38. A foundry core blowing machine as set forth in claim 37 including a cure head, a horizontal shuttle adapted to position the cure head between the cope and blow plate, said cure head being lifted off of said shuttle by said second clamp means whereby said shuttle may be retracted so that both said blow plate and curing head may form part of said tooling.

39. A foundry core blowing machine as set forth in claim 38 including laterally projecting pins on said cope and blow plate, and hook shape clamps pivoted on said blow head and cope support means adapted to engage said pins to secure said blow plate and cope thereto, respectively.

40. A foundry core blowing machine as set forth in claim 39 wherein said hook shape clamps are paired, and a single piston-cylinder assembly for each pair operative to swing said clamps.

41. In a cope and drag vertical core blowing machine, first clamp means to clamp the drag to the cope to form a core box, and second clamp means moving the core box to clamp said core box to a blow head and subsequently to a cure head, all while said first clamp means maintains the cope and drag clamped together.

42. A core blowing machine as set forth in claim 41 including guide rods, a cope mounting plate fixed to said guide rods, said first clamp means being operative to move the drag along said rods to clamp the drag to the cope.

43. A core blowing machine as set forth in claim 42 wherein said second clamp means is operative to move said rods and said first clamp means including the clamped cope and drag to clamp the core box as aforesaid.

* * * * *